US006007328A

United States Patent [19]

Seyed Yagoobi et al.

[11] Patent Number: 6,007,328

[45] Date of Patent: Dec. 28, 1999

[54] FLAME JET IMPINGEMENT HEAT TRANSFER SYSTEM AND METHOD OF OPERATION USING RADIAL JET REATTACHMENT FLAMES

[75] Inventors: Jamal Seyed Yagoobi; Robert H. Page, both of College Station, Tex.

[73] Assignee: The Texas A&M University System, College Station, Tex.

[21] Appl. No.: 09/062,789

[22] Filed: Apr. 16, 1998

Related U.S. Application Data

[60] Provisional application No. 60/044,138, Apr. 16, 1997.

[51] Int. Cl.[6] ..... F23D 11/44

[52] U.S. Cl. ..... 431/115; 431/350; 431/354; 126/39 J; 126/39 H

[58] Field of Search ..... 431/350, 354, 431/115, 116, 8, 9, 12; 432/122, 120; 126/39 H, 39 J, 39 F

[56] References Cited

U.S. PATENT DOCUMENTS 4,052,152 10/1977 Whelan et al. ..... 432/122

FOREIGN PATENT DOCUMENTS 01009821 1/1989 Japan ..... C03B 8/04
06279044 10/1994 Japan ..... C03B 37/018
WO 94/16277 7/1994 WIPO ..... F26B 13/00

OTHER PUBLICATIONS

International Search Report, mailed Aug. 13, 1998, International Application No. PCT/US 98/07892, filed Apr. 16, 1998.

Mohr, J.W., J. Seyed–Yagoobi, and R.H. Page, "Heat Transfer from a Pair of Radial Jet Reattachment Flames," *Proceedings of the 1996 31st ASME National Heat Transfer Conference*, Part 6 (of 8), Houston, Texas, vol. 328, No. 6, pp. 11–17.

Habetz, Darren K., Robert H. Page, and Jamal Seyed–Yagoobi, "Impingement Heat Transfer from a Radial Jet Reattachment Flame," *Heat Transfer 1994 Proceedings of the 10th International Heat Transfer Conference*, Brighton, United Kingdom, vol. 6, pp. 31–36.

*Primary Examiner*—James C. Yeung
*Attorney, Agent, or Firm*—Baker & Botts, L.L.P.

[57] ABSTRACT

A system for transferring heat to an impingement surface includes a first radial jet reattachment combustion nozzle operable to direct a flame toward the impingement surface and comprising a central longitudinal axis. The system also includes a second radial jet reattachment combustion nozzle operable to direct a flame toward the impingement surface and comprising a central longitudinal axis. The first and second nozzles are positioned such that the central longitudinal axes are substantially parallel and spaced apart such that flames directed from the first and second radial jet reattachment combustion nozzles interact with each other.

10 Claims, 9 Drawing Sheets

FLAME JET IMPINGEMENT HEAT TRANSFER SYSTEM AND METHOD OF OPERATION USING RADIAL JET REATTACHMENT FLAMES

RELATED APPLICATION

This application claims the benefit of U.S. Provisional Application Serial No. 60/044,138, filed Apr. 16, 1997, entitled FLAME JET IMPINGEMENT HEAT TRANSFER SYSTEM AND METHOD OF OPERATION USING RADIAL JET REATTACHMENT FLAMES.

TECHNICAL FIELD OF THE INVENTION

This invention relates in general to the field of industrial systems and methods and, more particularly, to a flame jet impingement heat transfer system and method of operation.

BACKGROUND OF THE INVENTION

Many industrial heat treating processes involving, for example, metals and glass, utilize gas-fired rapid heating as a means of achieving desired surface properties. The use of gas-fired rapid heating techniques for metal and glass products has many advantages over typical furnace heating techniques, namely: high thermal efficiency, improved product quality, faster heating response time, and increased productivity. During these processes, a flame or jet of hot combustion products directly impinges upon the object to be heated. Such impingement heating eliminates the need for large radiative furnaces, since up to 80 percent of the heat transfer occurs by convection. Also, greater control of the heat transfer process may be possible, due to the rapid response time of convective heating.

Two major problems are associated with the use of flame jet impingement for heat treatment processes. First, all of the data in the open literature are for round impinging in-line jet (ILJ) flames. The ability of these jets to heat a surface is highly dependent upon the nozzle Reynolds number and the nozzle-to-surface spacing (X). For pure diffusion flames, large X values ($X/D_r>40$) are required for the maximum heat flux to be achieved. This is due to the fact that ample residence time is required for the fuel to mix with surrounding air and burn prior to impingement upon the surface. Pre-mixing the fuel and air eliminates this problem and can improve the heat transfer, but most industrial processes tend to avoid full pre-mixing of fuel and air, due to the possibility of accidental flashback and exploding. Therefore, a type of nozzle that produces a partially pre-mixed flame that will also provide symmetric surface heating is utilized. One such nozzle is a Radial Jet Reattachment (RJR) nozzle, which is described in Page, R. H., Hadden, L. L., and Ostowari, C., 1989, "Theory for Radial Jet Reattachment Flow," AIAA Journal, Vol. 27, No. 11, pp. 1500–1505, which is incorporated herein by reference.

Radial Jet Reattachment nozzles have seen extensive use in non-reacting jet impingement heat transfer and drying processes. The aerodynamics of the RJR nozzle differs greatly from a standard ILJ nozzle, and this RJR flow pattern has been utilized to design a single Radial Jet Reattachment Combustion (RJRC) nozzle, which is described in Habetz, D. K., Page, R. H., and Seyed-Yagoobi, J., 1994, "Impingement Heat Transfer from a Radial Jet Reattachment Flame," 10th International Heat Transfer Conference, Brighton, U.K., Vol. 6, pp. 31–36, which is incorporated herein by reference. Although an RJRC nozzle produces a partially pre-mixed flame, a single RJRC nozzle may not be adequate to produce the desired results. However, no data exists regarding the performance of radial jet reattachment nozzles in an array configuration.

SUMMARY OF THE INVENTION

In accordance with the teachings of the present invention, a system for transferring heat to an impingement surface is provided that substantially reduces or eliminates disadvantages associated with prior methods and systems.

According to one embodiment of the present invention, a system for transferring heat to an impingement surface is provided that comprises a first radial jet reattachment combustion nozzle operable to direct a flame toward the impingement surface and comprising a central longitudinal axis. The system also includes a second radial jet reattachment combustion nozzle operable to direct a flame toward the impingement surface and comprising a central longitudinal axis. The first and second nozzles are positioned such that the central longitudinal axes are substantially parallel and spaced apart such that flames directed from the first and second radial jet reattachment combustion nozzles interact with each other.

According to an alternate embodiment of the present invention, a system for transferring heat to an impingement surface is provided that comprises an array of radial jet reattachment combustion nozzles each operable to direct a flame toward the impingement surface and each having a central longitudinal axis. The array includes comprising at least three radial jet reattachment combustion nozzles positioned such that the central longitudinal axes of the at least three racial jet reattachment combustion nozzles are substantially parallel and spaced apart such that flames directed from at least one of the radial jet reattachment combustion nozzles interact with flames from at least two other of the radial jet reattachment combustion nozzles.

Embodiments of the invention provide several technical advantages. For example, according to one embodiment a multiple nozzle system for transferring heat to an impingement surface is provided that provides greater heat transfer than single nozzle systems. In addition, according to one embodiment, multiple nozzles in a heat transfer system are spaced apart with optimal spacing to optimally benefit from interaction between adjacent nozzles that is not present with the use of a single nozzle to provide more efficient heat transfer characteristics.

Other technical advantages are readily apparent to one skilled in the art from the following figures, descriptions, and claims.

BRIEF DESCRIPTION OF THE DRAWINGS

A more complete understanding of the present invention may be acquired by referring to the accompanying FIGURES, where like reference numbers are used to refer to like features and wherein.

DETAILED DESCRIPTION OF THE INVENTION

Embodiments of the present invention and its advantages are best understood by referring to FIGS. 1 through 11 of the drawings, like numerals being used for like and corresponding parts of the various drawings.

Figure 1:
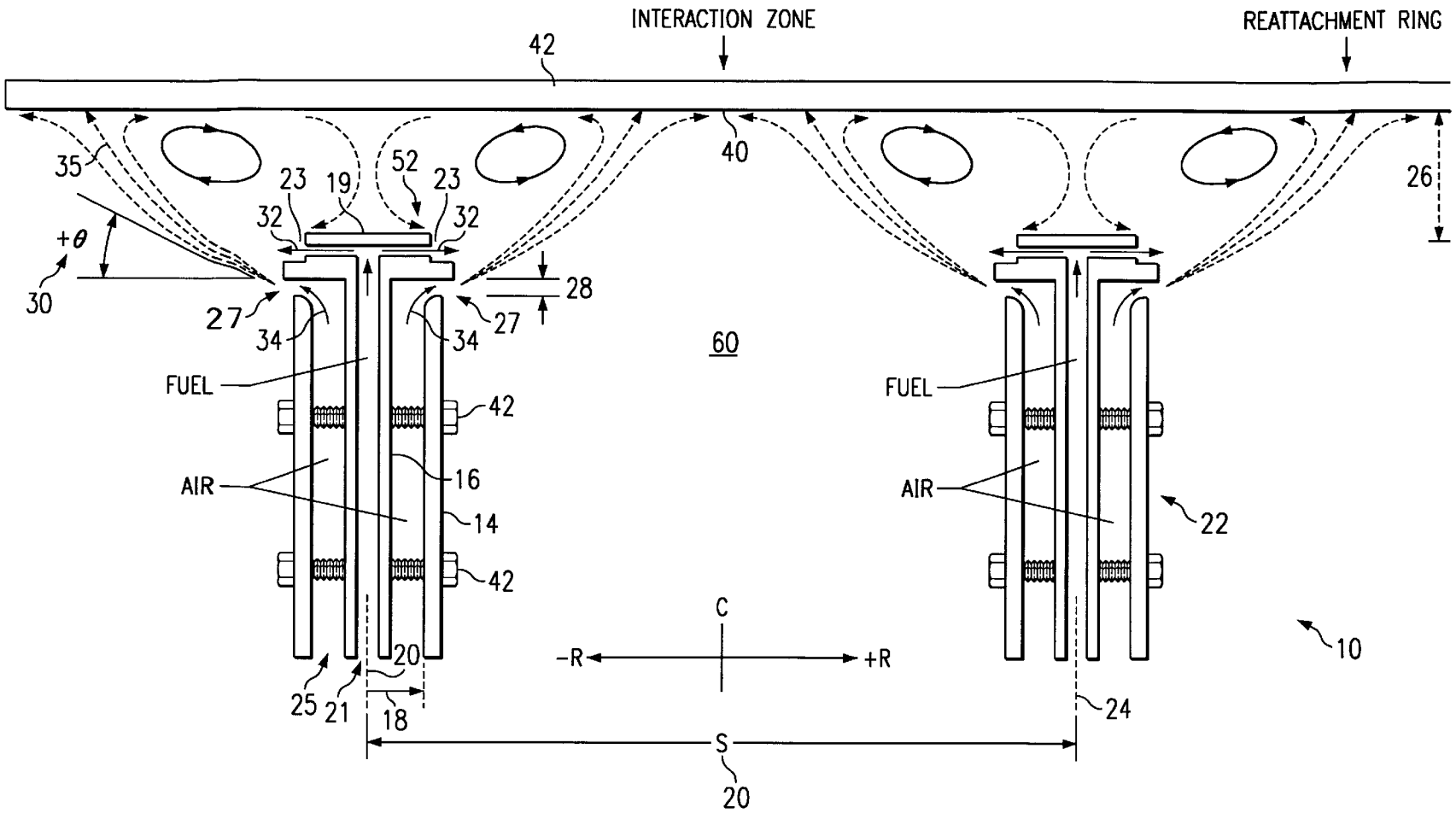
FIG. 1 is a schematic diagram illustrating a typical flow pattern for a pair of RJR or RJRC nozzles.

FIG. 1 is a schematic diagram illustrating a heat transfer system 10. Heat transfer system 10 includes Radial Jet Reattachment Combustion (RJRC) nozzles 12 and 22. Nozzle 12 includes an air pipe 14 and a fuel pipe 16. Air pipe 14 has inside radius 18 of $R_0$. Fuel pipe 16 and air pipe 14 may be coupled according to conventional techniques including coupling by fasteners 42. Fuel pipe 16 and nozzle 12 has a central axis 21. Fuel 32 flows into an inlet 21 of fuel pipe 16 and exits through radial exits 23. A radial deflecting surface 19 deflects fuel 32 causing fuel 32 to exit through radial exit 23. Air 34 flows into air pipe 14 at entrance 25 and exits through aperture 27 in air pipe 14. Air 34 exits air pipe 14 at an air exit angle 30. Aperture 27 has a nozzle exit gap width 28.

Thus, fuel 32 flowing through fuel pipe 16 is forced to exit in an outward radial direction. Viscous mixing and secondary mass entrainment causes the pressure between nozzle 12 and an impingement surface 40 to decrease below the surrounding air pressure. Impingement surface 40 is a surface of a plate 42 that is heated by nozzles 12 and 22. The distance between impingement surface 40 and nozzle exit 23 is a nozzle-to-surface spacing 26. As a result, an exiting air jet 35 is turned toward impingement surface 40 where it impinges in a highly turbulent reattachment ring centered about nozzle 12. This reattachment ring has a very high convective heat and mass transport properties, which also promotes good mixing of fuel and oxidizer. The size of a ring-shaped stagnation region the reattachment ring is dependent upon a nozzle to surface spacing 26, air exit angle 30, and nozzle exit gap width 28, which controls the air exit velocity. In one embodiment, exit 23 includes evenly spaced slots around the circumference of a top 52 of nozzle 12. In the same embodiment, each slot is 2.54 mm tall and 2.54 mm wide.

Because fuel 32 and air 34 flows can be independently controlled, RJRC nozzle 12 effectively becomes a partially pre-mixed combuster. A net force exerted on impingement surface 40 by nozzle 12 can be negative, null, or positive, depending on the magnitude of air exit angle 30. In one embodiment of the invention, exit angle 30 is 10°, which results in a slight positive force on impingement surface 40 in the reattachment ring.

A second radial jet reattachment combustion nozzle 22 is illustrated in FIG. 1. Second nozzle 22 is substantially similar to nozzle 12 and includes a central axis 24. Central axis 21 of nozzle 12 and central axis 24 of nozzle 22 are spaced apart by a nozzle spacing 20. Locating two nozzles adjacent one another introduces interaction between air, fuel, and a resulting flame exiting nozzle 12 with air, fuel, and a resulting flame exiting nozzle 22 that does not occur with the use of a single nozzle. This interaction affects heat transfer and other properties of heat transfer system 10, as described in greater detail below. Due to such interaction, the use of a pair of nozzles introduces complications in the design of heat transfer system 10. For example, the magnitude of nozzle spacing 20 affects heat transfer and other properties of heat transfer system. The interaction of air, gases, and the resulting flames exiting nozzles 12 and 22 is described below with reference to experimental data that was obtained using a test system illustrated in FIG. 2.

Figure 2:
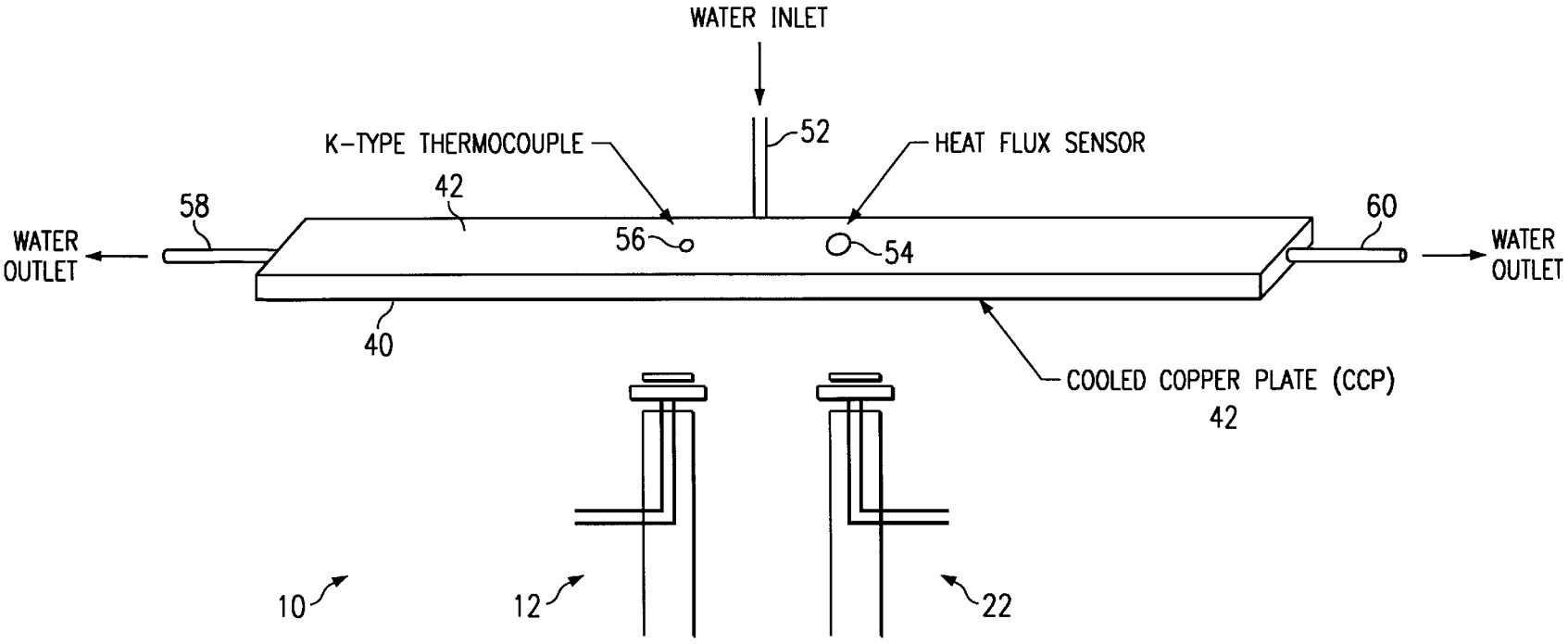
FIG. 2 is a schematic diagram showing the relationship of the nozzles to the impingement surface.

FIG. 2 is a schematic diagram showing an example test system 50 for heat transfer system 10. Heat transfer system 10 produces a flame for impinging upon plate 42 having impingement surface 40. A water inlet 52 provides water to plate 42. Water within plate 42 exits through water outlets 58. A change in the temperature of water within plate 42 is sensed by a thermocouple 56 and the amount of heat flux is measured by heat flux sensor 54. In this example test system 50, plate 42 is a 6.35 mm thick, 0.836 $m^2$ water-cooled copper plate (CCP) heat exchanger. One side of plate 42 serves as the impingement surface 40 while the other side of plate 42 is uniformly cooled by running water received by water inlet 52. Additional details of testing system 50 are described below in conjunction with FIGS. 3 through 6.

FIGS. 3 through 6 illustrate data obtained from test system 50, illustrated in FIG. 2. All measurements were obtained under steady-state conditions. The steady-state was reached when the exit temperature of the cooling water at water outlets 58 and 60 ceased to change following a change in burner operating conditions. The total heat transfer rate to the plate 42 on an integral basis was determined by measuring the cooling water flow rate and its change in temperature, with the cooling water flow rate held constant at 15.1 liters/min. The change in temperature was measured using thermistor thermometers (not explicitly shown) with an accuracy of ±0.2° C.

In order to provide a measure of the efficiency of the combustion process, the rate of impingement surface heat transfer (q) to the plate 42 was normalized by the rate of energy available from the fuel input nozzle system 10 ($q_{fuel}$). The resulting variable was designated as the heat transfer ratio, $R_t$. The total available energy rate was determined by multiplying the heating value of the working gas by its flow rate. The working gas in this study was utility natural gas having a heating value of 61594 kJ/kg.

The heat flux of impingement surface 40 was measured with a single Vatell Corporation HFM-2 heat flux sensor 54 mounted flush with the front side of impingement surface 40, as shown in FIG. 2. Heat flux sensor 54 is 25.4 mm in diameter and 2 $\mu$m thick and mounted on a 6.35 mm thick aluminum nitride substrate (not explicitly shown). Heat flux sensor 54 is cooled from the backside in an identical manner as plate 42. Heat flux profiles along the impingement surface 40 were possible by moving the RJRC flames horizontally, while the impingement surface and heat flux sensor remained stationary. Each local heat flux measurement represented the average of 1500 data points sampled at a rate of 33 samples per second.

Following each test, any soot that may have been deposited on the heat flux sensor 54 was removed by cleaning. The near-surface temperature of the plate 42 was measured with a K-type thermocouple 56 (20 AWG) with a calibrated accuracy of ±0.5° C. This thermocouple 56 was silver-soldered to the bottom of a hole drilled from the rear of the plate 42 to within 1.5 mm of the impingement side. As shown in FIG. 2, thermocouple 56 was mounted in line with the heat flux sensor 54, allowing for temperature profiles through horizontal movement of the RJRC flames in an identical manner as the heat flux profiles were obtained. The distance between heat flux sensor 54 and thermocouple 56 was large enough to eliminate interference between the temperature or heat flux measurements. Also, thermocouple 56 was thermally and electrically insulated from the cooling water.

Using the method described in Kline, S. J., and McClintock, F. A.,. 1953, "Describing Uncertainties in Single Sample Experiments." *Mechanical Engineering,* Vol. 75, pp. 3–8, the uncertainty in the heat flux meter calibration was 7.3 percent, while the minimum and maximum uncertainties for all of the reported heat flux values were 1.16 and 12.0 percent, respectively. The minimum and maximum uncertainties for the surface temperature data were 0.77 and 1.05 percent, while the uncertainty in the equivalence ratio, based on metered air and fuel flow rates was 4.0 percent. The uncertainty in the reported heat transfer ratio ($R_t$) was 7.9 percent.

Three runs at a between-nozzle spacing ratios of $S/R_o$=8.0 were conducted and averaged, where S is the between-nozzle spacing and/or center-to-center nozzle spacing parallel to the y-axis and $R_o$ is the inside radius of the air supply pipe. This spacing was chosen because it provided the highest local heating flux to impingement surface 42. The standard deviation of the heat transfer ratio for the three runs was 0.36 percent. The minimum and maximum standard deviations in local heat flux values were 0.49 and 12.93 percent of the reported mean heat flux values. Repeatability data for the plate surface temperature measurements showed minimum and maximum standard deviations to be 0.33 and 2.28 percent of the calculated mean temperature.

For the system illustrated in FIG. 2, each nozzle 12, 22 operated under the following conditions: fuel mass flow rate=0.0223 kg/min, fuel equivalence ratio=(fuel) (air ratio) actual/(fuel/air ratio) stochiometric 30=1.0, nozzle-to-surface spacing 26=10.0 mm, and nozzle exit gap width 28=3.68 mm.

The flow structure and appearance from the flow determined by test system 50 is described below with reference to FIG. 1. As suggested by the streamlines shown in FIG. 1, the RJRC flame for each nozzle was axisymmetric about a centerline through the associated nozzle. For all between nozzle spacing ratios ($S/R_0$, the combined flames were blue in color with very little orange present. When the between-nozzle spacing ratio was small, ($S/R_o$<6.0), the flow fields from the two nozzles were highly interactive. In fact, at the closest spacing utilized in this study ($S/R_o$=5.0), the shapes of the individual jets were significantly altered. At this spacing, the two jets impinged upon each other prior to being able to impinge upon impingement of surface 40. As a result, the jets coalesced together to form one large elliptic flame, as compared with two distinct circular flames. At larger between-nozzle spacings (6.0<$S/R_o$<9.0), the jets were moderately interacting and two distinct circular jets could be seen on the nor-interaction sides of each RJRC nozzle. In an interaction region 60, FIG. 1, the two jets interacted with each other. The flames were forced downward away from the plate following impingement upon each other. This downward flow was created by the need to satisfy the continuity relation of the interacting jets. For the largest spacing ($S/R_o$=11.0) the two jets were weakly interacting with each other and two separate circular flames were observed.

In the region between the two jets, each jet was able to impinge upon impingement surface 40 only when the between-nozzle spacing was greater than $S/R_o$=6.0. This spacing corresponded with the size of the reaction zone for a single RJRC nozzle operating under identical conditions, indicating that the two flames were almost non-interacting with each other at $S/R_o$>8.0. Following impingement upon surface 40, the jets were forced to exit the zone of interaction in a direction perpendicular to the line connecting the two nozzles 12, 22. For the non-interacting sides, the flames moved out from the nozzle centerline in a circular pattern typical of a symmetric jet. For all between-nozzle spacings, the flame jets were very stable and very little soot deposition was observed.

Figure 3:
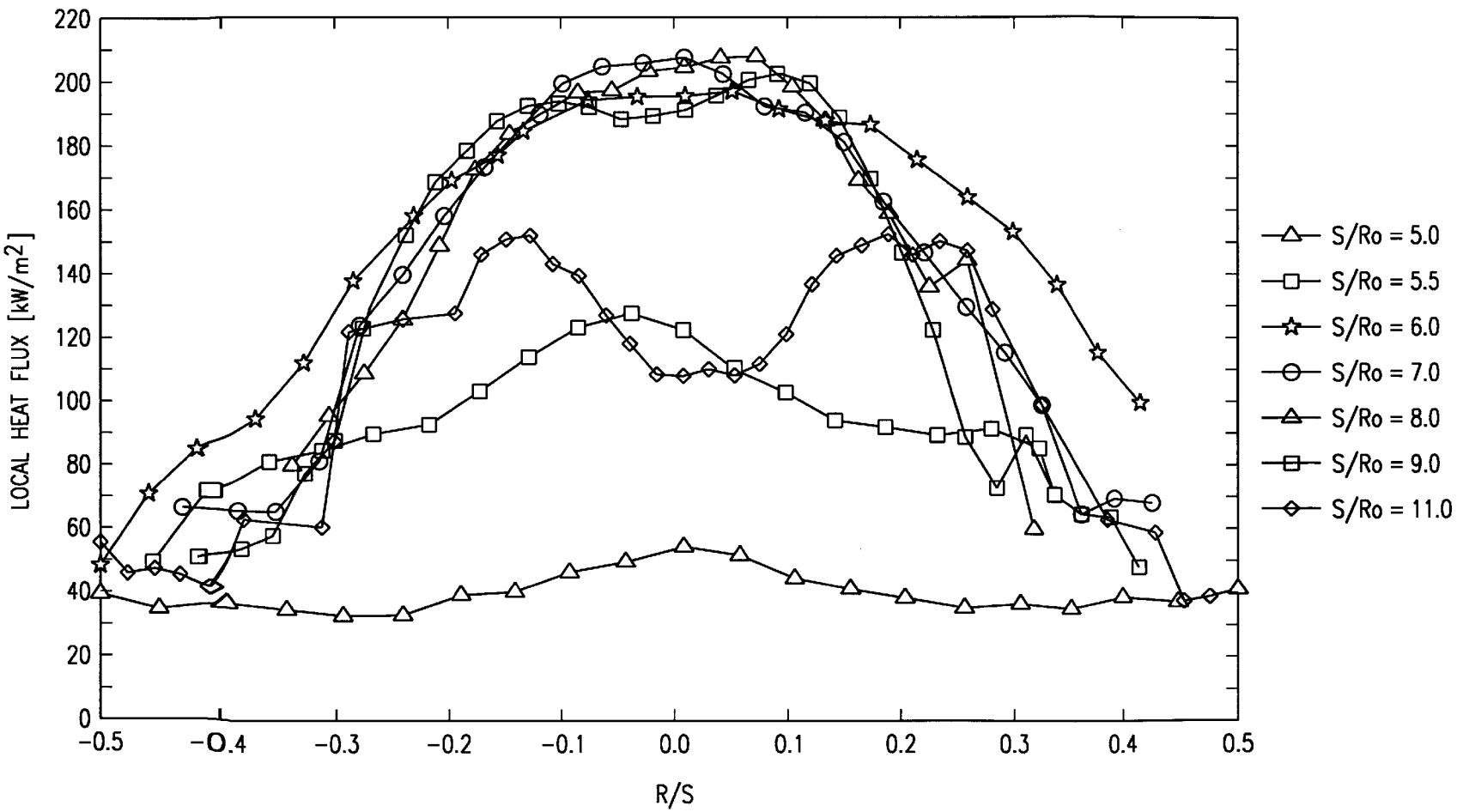
FIG. 3 is a graph illustrating impingement surface heat flux distribution.

FIG. 3 is a graph illustrating heat flux distribution on impingement surface 42 for tests conducted with test system 50. Heat flux distributions on impingement surface 40 resulting from tests performed on test system 50 are described below in conjunction with FIG. 3. The horizontal coordinate of FIG. 3 is such that R/S=0 corresponds to the midpoint between the two nozzles 12, 22, where R is the radial location and S is the between-nozzle spacing 20. Small asymmetries of the heat flux profiles about the midpoint R/S=0 are due to slight differences in the construction of nozzles 12 and 22.

Heat flux profiles at seven different between-nozzle spacings were obtained, with the smallest spacing being $S/R_o$=5.0. At this smallest spacing, the heat flux profile is fairly uniform, but the measured heat fluxes are much lower than the values obtained at larger spacings. These lower heat fluxes are attributed to the change in aerodynamic structure as previously mentioned. The elliptic structure of the two combined flames at $S/R_o$=5.0 is such that direct impingement of the flame on the surface of plate 42 is inhibited, providing a fairly constant surface heat flux of 30–50 kW/$m^2$ between the nozzles. As the spacing was increased to $S/R_o$=5.5, partial impingement of the flames upon the plate 42 occurred, indicated by the higher peak heat flux at the midpoint between the nozzles.

An increase in the spacing to $S/R_o$=6.0 shows a tremendous increase both in the magnitude of the heat flux and in the width of the high heat flux region between the nozzles. By increasing the spacing between nozzles 12 and 22, a greater volume is created wherein the combustion reactions can occur. Also, at these larger spacings, each individual jet is able to impinge upon plate 42 prior to interaction with the other jet. As a result, the slope of the heat flux profiles for $S/R_o$=6.0, 7.0, and 8.0 is very uniform near the measured peak heat flux for each profile. Therefore, a higher and more uniform heat flux is obtained by increasing the between-nozzle spacing from $S/R_o$=5.5 to $S/R_o$=6.0.

Such a small change in spacing demonstrates the much greater sensitivity of reacting jets to between-nozzle spacing 20 than is observed with isothermal jets. The large peak heat flux values for $S/R_o$=6.0, 7.0, and 8.0 are almost 50% higher than the measured local heat flux from a single nozzle operating under identical conditions. This increase is attributed, at least in part, to the greater fuel input for the two nozzle system compared with the single nozzle. The high heat flux for the nozzle pair is also attributed to the turbulent flow field between the moderately interacting jets. Turbulence has the effect of increasing the convection coefficient to the impingement surface as well as enhancing the mixing, and hence, combustion rate of the fuel and air.

A further increase in the width of the high-heat flux region is again observed as the spacing is increased to $S/R_o$=9.0.

This profile differs from the previously discussed profiles in that two maximums in the profile are present. These maximums correspond to the point of impingement for each individual RJRC jet 12, 22, and the peak local heat flux is lower than the $S/R_o$=7.0 and 8.0 profiles. The slight "dip" in the heat flux profile still allows for a very uniform surface heating over a distance R/S≈±0.15. The "dip" in the heat flux profile is much more pronounced at the wider spacing of $S/R_o$=11, which also shows a much lower peak heat flux value. While still showing some interaction at R/S=0 (flux≈100 $kW/m^2$), the two RJRC jets 12, 22 are operating, for the most part, independently of each other and are weakly interacting at $S/R_o$=11.0. Previous data for a single RJRC nozzle showed the peak heat flux to be about 140 $kW/m^2$, which is very consistent with the peak heat flux measured for the weakly interacting case of $S/R_o$=11.0.

Figure 4:
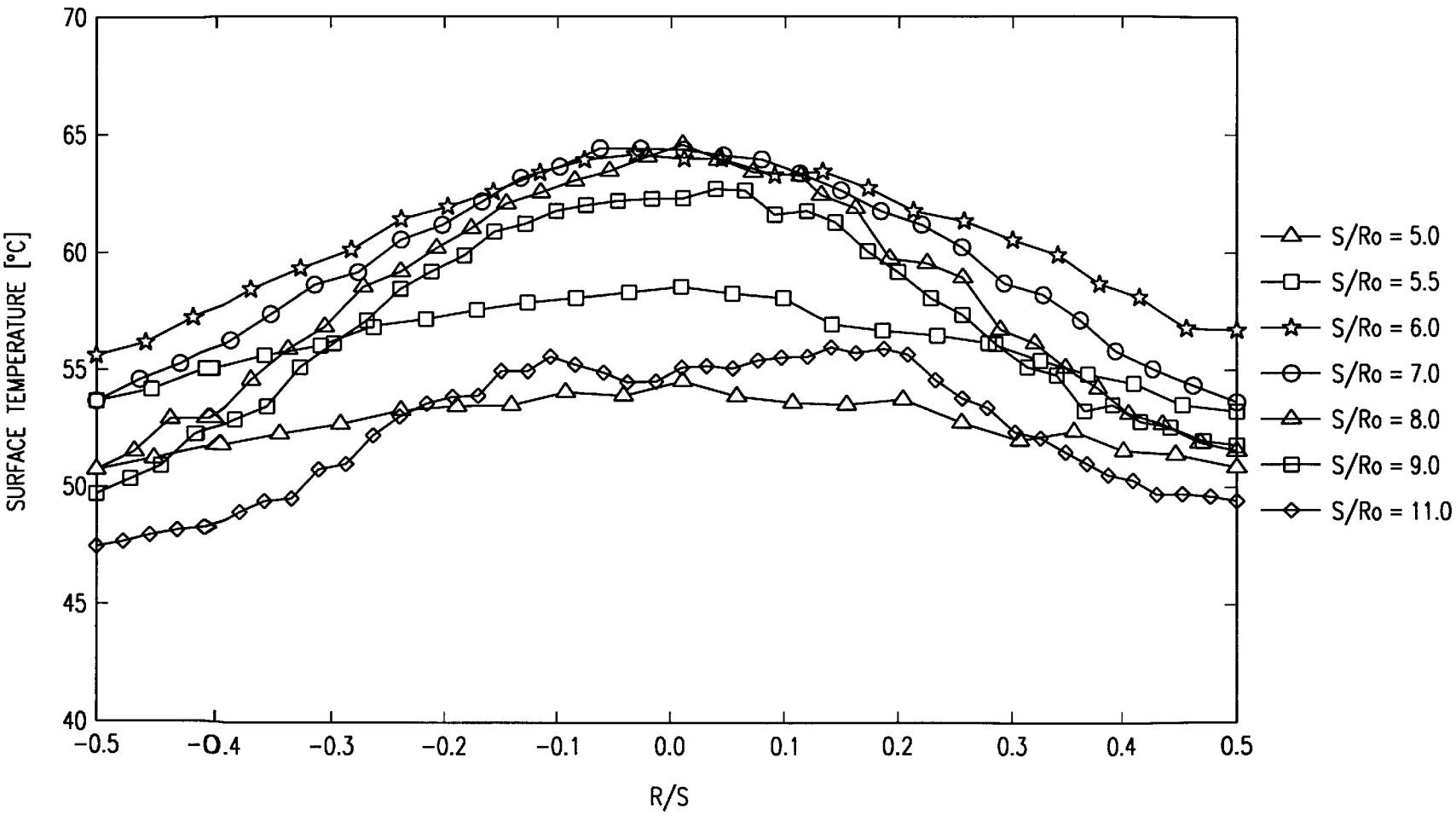
FIG. 4 is a graph illustrating impingement surface temperature distribution.

FIG. 4 shows temperature distributions of impingement surface 40 as measured with the thermocouple 56 mounted into impingement surface 40. These resulting temperature distributions are described below in conjunction with FIG. 4. The low surface temperatures which are less than 70° C., are due to the high conductivity of the copper impingement surface 40 and the low temperature and high flow rate of cooling water. The magnitudes of the measured temperatures follow almost exactly the observed trends in the heat flux data illustrated in FIG. 3 with respect to the influence of between-nozzle spacing 20 (S). Consistency between the heat flux and temperature data demonstrates the integrity of the data and shows that the heating characteristics of the two RJRC nozzles 12, 22 are highly sensitive to between-nozzle spacing 20.

As seen in FIG. 4, the highest surface temperatures were measured at between-nozzle spacing ratios in the range $6.0<S/R_o<8.0$. At both smaller and larger spacings the temperatures are lower, although a more uniform temperature distribution results. Note that two maximums are also observed in the profile for $S/R_o$=11.0, indicative of the two distinct RJRC jets.

Figure 5:
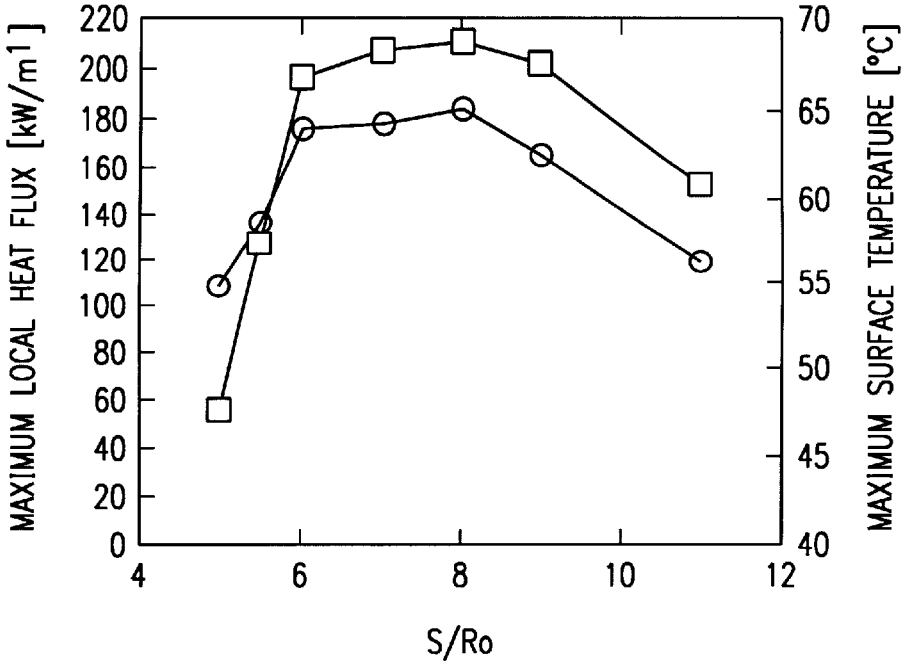
FIG. 5 is a graph illustrating the effect of nozzle spacing on maximum impingement surface heat flux and temperature.

FIG. 5 is a graph illustrating the effect of nozzle spacing 20 on the maximum flux and temperature of impingement surface 40. The data in FIGS. 3 and 4 were combined with overall heat transfer data to produce FIG. 5. The optimal spacing for the RJRC nozzle pair 12, 22, is described with reference to FIG. 5. The optimal spacing in terms of maximum local heat flux and maximum surface temperature is illustrated to be $S/R_o$=8.0. When the two nozzles 12, 22 are moderately interacting over the range of spacing ratios $6.0<S/R_o<9.0$, near maximum local heat flux and temperature values are possible. This fact suggests that one could place nozzles 12 and 22 slightly closer or father apart and still achieve near peak heat transfer performance.

Figure 6:
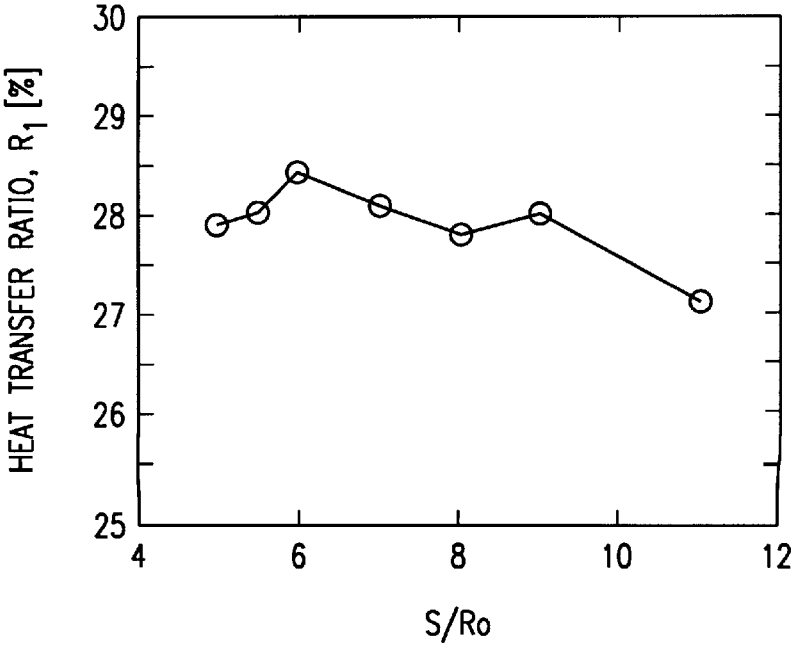
FIG. 6 is a graph illustrating the change in the percent of overall heat transfer to the impingement surface.

FIG. 6 illustrates the percent overall heat transfer to impingement surface 40 as a function of between-nozzle spacing ratios. The most energy efficient heat transfer, represented by ℞, occurs at a between-nozzle spacing ratio of $S/R_o$=6.0. The higher overall heat transfer at $S/R_o$=6.0 compared with $S/R_o$=7.0, 8.0, and 9.0 is attributed to the relative sizes of the reaction zone and the impingement surface. With a constant area impingement surface, the larger reaction volume associated with an increase in $S/R_o$ suggests a decrease in the heating efficiency. Although the overall heat transfer is a moderate function of $S/R_o$, a small percent savings in energy consumption could produce substantial savings for a large-scale heating process. However, since the entire impingement surface is acting as a heat sink, the RJRC flame will eventually come in contact with surface 40, regardless of the $S/R_o$ spacing. Therefore, the percent overall heat transfer remains nearly constant, as shown in FIG. 6.

In the zone of interaction 60 between the nozzles, the local heat flux was a strong function of nozzle spacing. The maximum heat flux and impingement surface 40 temperatures were measured at a between-nozzle spacing of $S/R_o$=8.0, while the lowest values were measured at $S/R_o$=5.0. The optimal spacing for the two nozzles is when they were moderately interacting ($6.0<S/R_o<9.0$) Very high local heat flux values are possible with the RJRC nozzle pair, and the zone of high heat flux becomes wider with increasing between-nozzle spacing.

Thus, due to interaction between air, fuel, and resulting flames exiting from adjacent nozzles the heat transfer properties for heat transfer system 10 differ from those of a single nozzle, with optimal spacing between an adjacent pair of nozzles described above. An array of nozzles is defined as three or more adjacent nozzles. An array of nozzles introduces additional complexity because fuel, air, and resulting flames from at least one nozzle interact with fuel, air, and flames from at least two adjacent nozzles. A heat transfer system utilizing an array of nozzles is described in conjunction with FIGS. 7 through 11.

Figure 7:
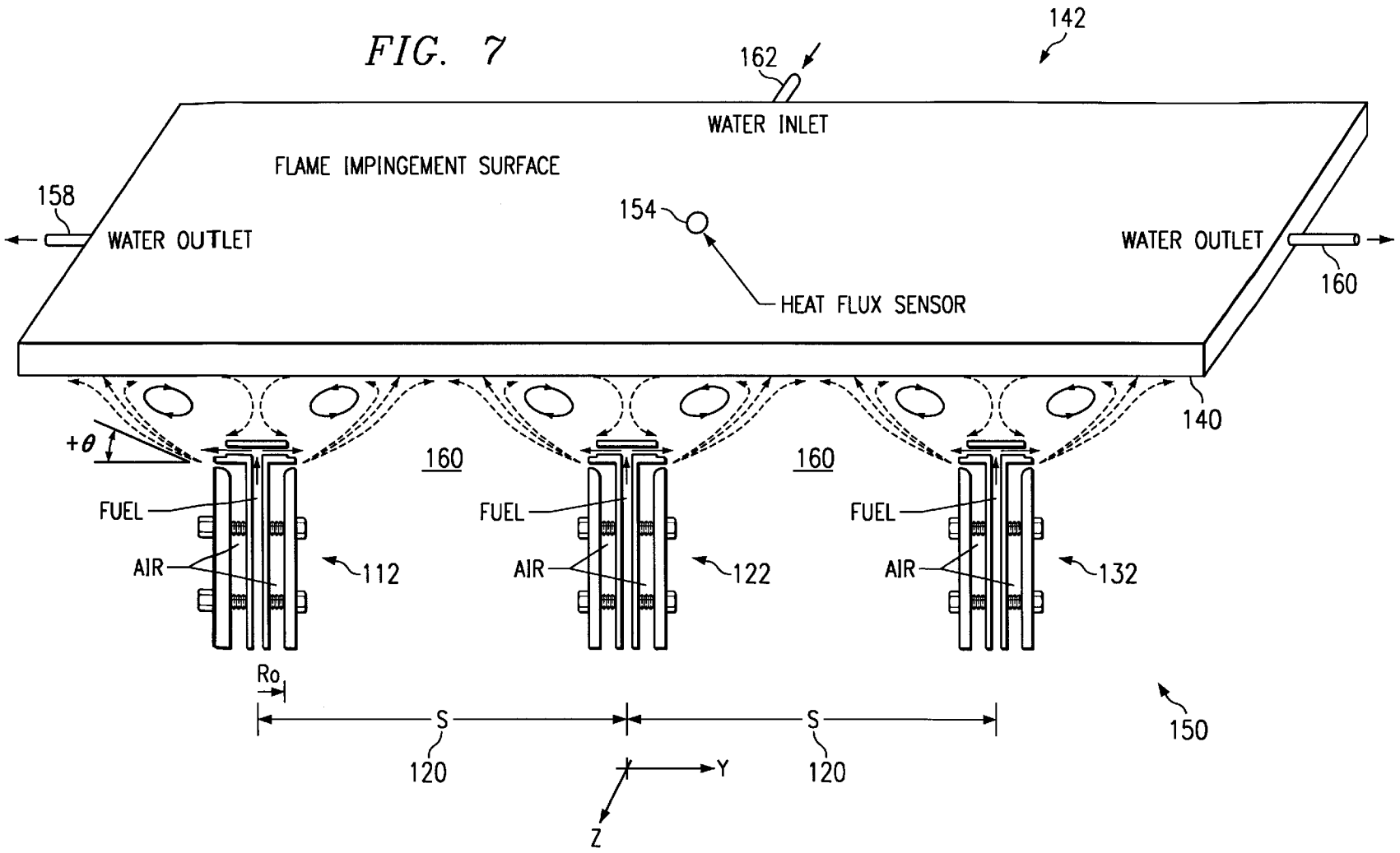
FIG. 7 is a schematic diagram illustrating an array of three RJRC nozzles and typical flow patterns.

FIG. 7 illustrates a heat transfer system 150 and impingement plate 142. Heat transfer system 150 includes an array of nozzles 112, 122, and 132 each spaced apart by a distance 120. Nozzles 112, 122 and 132 are identical to nozzles 12 and 22, which are described above in conjunction with FIGS. 1 and 2.

Heat transfer system 150 and plate 142 form a portion of a testing system for testing heat transfer system 150, which includes an array of nozzles 112, 122 and 132. Due to the interaction of air, fuel, and resulting flames from one nozzle, 122, with at least two other nozzles, 112 and 132, which corresponds to an array of nozzles, the heat transfer and other properties of heat transfer system 150 differ from a heat transfer system utilizing only one or two nozzles. The spacing between nozzles is particularly related to this interaction. It should be understood that heat transfer system 150 may include three or more nozzles, and is not limited to three nozzles. This interaction is described below with reference to test data obtained through the testing system illustrated in FIG. 7.

Details of the testing system illustrated in FIG. 7 are described below. The RJRC nozzles 112, 122, and 132 are shown in relation to the impingement surface 140 in FIG. 7. The flame impingement surface 140 is one side of a 6.35 mm-thick, 0.836 $m_2$ water-cooled plate (CCP) 142 heat exchanger 142. The other side of plate 142 is uniformly cooled by running water. All measurements were obtained under steady-state. The steady-state was reached when the exit temperature of the cooling water ceased to change following a change in burner operating conditions. The working gas in this study was utility natural gas having a heating value of 53.326 kJ/kg.

Impingement surface heat flux and surface temperature were measured with a single factory calibrated Vatell Corporation HFM-6 heat flux sensor 154 mounted flush with the front side of impingement thermocouple pairs of platinum and nichrome wires (not explicitly shown) placed in a dense rectangular pattern over an area of 4.0 $mm_2$ for measurement for heat flux. The heat flux is determined from standard methods, wherein a temperature gradient is measured through a material of known conductivity. Surface temperature is measured by means of a circular thin film resistance temperature sensor surrounding the rectangular pattern. Based on the heat flux sensor 154 construction, the area averaged (area=4.0 $mm^2$) values of heat flux and surface temperature are the actual measured variables.

The conducting and insulating sensor patterns are applied to an aluminum nitride substrate by a masked sputtering process. As a result, the depth of the HFM-6 sensing pattern is less than 2 $\mu$m, making it nearly invisible to any boundary layer flow across the heat flux sensor 154. The heat flux sensor 154 and aluminum nitride substrate are contained within the aluminum tube which is secured within a specially designed copper block. The copper block is threaded into a hole near the center of the flame impingement surface 140. Openings machined into a copper mounting block allow the heat flux sensor 154 to be cooled from the backside in an identical manner as the remainder of the flame impingement surface 140.

Heat flux and surface temperature profiles along the impingement surface 140 were possible by moving the RJRC flames in the ±y- and ±z-directions, while the impingement surface 140 and heat flux sensor 154 remained stationary. Following each test, any soot that may have been deposited on the heat flux sensor 154 was removed by cleaning. Each local heat flux and surface temperature measurement represented the average of 14,336 data points sampled at a rate of 500 samples per second. Local heat flux values were normalized by the maximum possible average heat flux over the entire impingement surface 140. The maximum average heat flux was obtained by dividing the heating capability of the natural gas, $q_f$, by the impingement surface area, A. This normalization procedure allows the data obtained in this study to be compared to other data obtained using different fuels and impingement surface sizes.

Three different fine-wire (50, 125, and 200 $\mu$m), type S, thermocouple probes were constructed and utilized to obtain flame temperatures in the y- and z-directions. Because of radiation, the three different sized thermocouples gave different temperatures, as long as the temperature was above about 1,100° C. The radiation losses were accounted for by extrapolating the temperature data versus bead diameter to zero bead diameter. Reported flame mean temperatures represented the average of 6,144 samples obtained at a rate of 200 samples per second. Measured flame temperatures were normalized by the adiabatic flame temperature obtained from thermodynamic equilibrium calculations.

Using the method described in Kline, the minimum and maximum uncertainties for all the reported heat flux values were 2.5 and 4.8 percent, respectively. The maximum uncertainty for the surface temperature data was estimated to be 10.0 percent, while the uncertainty in the equivalence ration (based on metered air and fuel flow rates) was 5.6 percent. The maximum uncertainty for the radiation corrected flame temperatures was approximated to be 10.0 percent.

Several heat flux profiles in the y-direction at a between-nozzle spacing of $S/R_o$=8 were measured and averaged. This spacing was chosen because it provided the highest local heat flux to the impingement surface. The minimum and maximum standard deviations in local heat flux values were 0.8 and 11.1 percent of the reported mean heat flux values. Repeatability data for the plate surface temperature measurements showed minimum and maximum standard deviations to be 0.5 and 2.9 percent of the calculated mean temperature. Five different flame temperature profiles in the z-direction at $S/R_o$=8, $H/R_o$=80.6, and y/S=0.0 were measured and averaged, where H is the distance from impingement surface parallel to x, the coordinate direction perpendicular to the impingement surface, and y is the coordinate direction parallel to the impingement surface and parallel to S. This particular set of conditions was arbitrarily chosen and is representative of the repeatability of all flame temperature data. The minimum and maximum standard deviations from the calculated mean of the five runs were 0.1 and 3.1 percent, respectively.

A possible optimal operating condition for a single and double practical RJRC nozzle was identified. Those operating conditions were as follows: $m_f$, the mass flow rate of fuel in the fuel pipe, =0.0223 kg/min, the fuel equivalence ratio=1.0, $X_p/R_o$=1.2, where $X_p$ is the nozzle-to-plate spacing and $R_o$ is the inside radius of the air supply pipe, and $b/R_o$=0.29, where b is the RJR nozzle exit gap width. For the testing of the three-nozzle array 150, including the three nozzle array of nozzles 112, 122, and 132 each nozzle 112, 122, and 132 was operating under the conditions of these same conditions. The origin of the coordinate system for the three-nozzle array shown in FIG. 7 does not match with the origin of coordinate system in the pair of RJRC nozzles illustrated in FIGS. 1 and 2. Impingement surface heat flux and surface temperature profiles are reported for RJRC array 150 operating at seven different-nozzle spacings, covering the entire angle from weakly to highly interacting flames. Profiles parallel and perpendicular to the line connecting the three nozzles are reported. In addition, flame temperatures are also reported as a function of between-nozzle spacing and distance from the impingement surface. Future work will address the momentum interactions between the flames to determine the mass entrainment of the system.

The internal air system of the RJRC nozzles 112, 122, and 132 forces air to exit the nozzle in an outward radial direction. Viscous mixing and secondary mass entrainment causes the pressure between the nozzle and impingement surface 140 to decrease below the surrounding air pressure. As a result, the exiting air jet is turned toward impingement surface 140 where it impinges in a highly turbulent reattachment ring centered about the nozzle.

The flame structure and appearance for the RJRC nozzle array 150 is described below. The observed flow structure for three flames was very similar to the flow for two flames described in conjunction with FIG. 1. Based on the magnitude of the heat flux for each between-nozzle spacing ratio, three types of flames were observed. When the flames were weakly interactive at $S/R_o$>9, three distinct RJRC flames were present. Note how each RJRC flame is symmetric about its nozzle and seems to be operating independently of the other flames in FIG. 7. Each flame is blue in color and no yellow tips are observed. As nozzles 112, 122, and 132 are brought closer together, the three flames become moderately interactive for $6<S/R_o<9$. The round jet of each RJRC nozzle was still preserved, but there were clearly two regions of interaction on either side of center nozzle 122. In the region between the two nozzles where the jets interacted with each other, the flames were blue in color and were forced downward away from the plate following impingement upon each other.

At very small between-nozzle spacings ($S/R_o$<6), the three flames were highly interactive and coalesced into one large elliptic flame. Contrary to initial intuition, the flame color is still blue, indicating intense combustion and heat release. Instead of inhibiting combustion, the close proximity of the three jet flames destroys the round nature of each jet and creates a new flame shape. Such a change in structure is likely caused by the need to satisfy mass continuity within the relatively small combustion volume.

In the region between center nozzle 122 and the two outside nozzles, 112, 132 impingement upon impingement surface 140 took place only when the between nozzle spacing was greater than $S/R_o$=6.0. This spacing corresponds with the measured size of the reaction zone for a single RJRC nozzle operating under identical conditions. Following impingement upon surface 140, the jets were forced to exit a zone of interaction 160 in a direction perpendicular to the line connecting the two nozzles. For the non-interacting sides, the flames moved out from the nozzle centerline in a circular pattern typical of a symmetric jet. For all between-nozzle spacings, the flame jets were very stable and very little soot deposition was observed.

Figure 8:
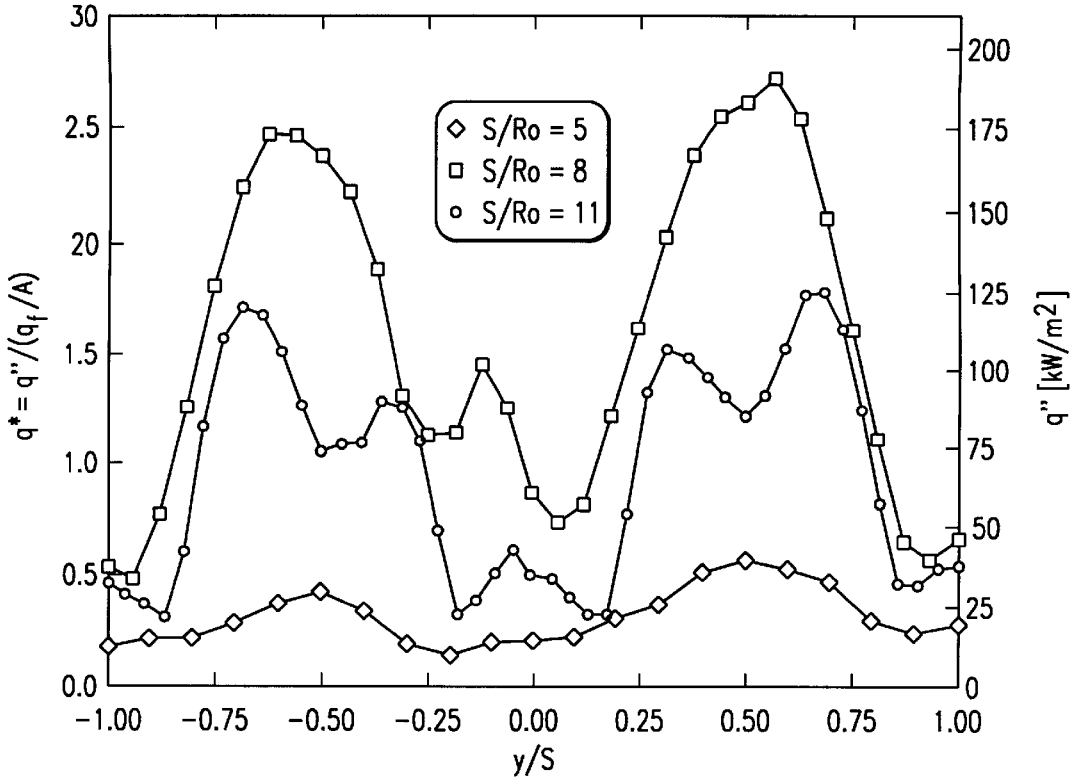
FIG. 8 is a graph illustrating the impingement surface heat flux distribution in the y-direction.

FIG. 8 is a graph illustrating heat flux distribution in the y-direction on impingement surface 140 that was measured using the test system illustrated in FIG. 7. Both non-dimensional and actual heat flux values are included in FIG. 8. The horizontal coordinate is such that y/S=0 corresponds to the midpoint between the two neighboring nozzles. Also the non-dimensional local heat flux values, q", were mostly greater than unity within the region of interest because the local heat flux, q", was normalized by the maximum possible average heat flux over the entire impingement surface 40. Heat flux profiles at seven different between-nozzle spacings were obtained over the range of 5.0<11.0, however, the data are provided for three spacings only. At the smallest spacing ($S/R_o$=5.0), the heat flux profile is fairly uniform, but the measured heat fluxes are much lower than the values obtained to the larger spacings. These lower heat fluxes are attributed to the change in aerodynamic structure as previously mentioned. The elliptic structure of the combined flames at $S/R_o$=5.0 is such that direct impingement of the flame on the surface of the y direction is inhibited, providing a fairly low and uniform surface heat flux. Partial impingement of the flames upon the surface occurred at $S/R_o$=5.5.

At $S/R_o$=6.0 a tremendous increase both in the magnitude of the heat flux and in the non-dimensional width of the high heat flux region between the nozzles was observed. Such a small change in between-nozzle spacing ratios demonstrates the much greater sensitivity of reacting jets to between-nozzle spacing than is observed with non-reacting jets. By increasing the spacing between the nozzles, a greater volume is increased wherein the combustion reactions can occur. Also, at higher spacings, each individual jet is able to impinge upon the impingement surface prior to interaction with the other jet.

The highest heat flux to the impingement plate occurred at the spacing of $S/R_o$=8, corresponding to moderately interacting flames. The large peak heat flux values with moderately interacting flames are higher than the corresponding heat flux from a single nozzle operating under identical conditions partially due to the greater fuel input for the three nozzle system compared with the single nozzle. The high local heat flux for the moderately interacting RJRC flames, relative to the single RJRC nozzle, is also attributed to the turbulent flow field between the moderately interacting jets. Turbulence has the effect of increasing the convection coefficient to the impingement surface as well as enhancing the mixing of the fuel with air. However, the heat flux values of three RJRC nozzles (array) at the same spacing and under identical operating conditions are lower compared to those of two RJRC nozzles 12 and 22 illustrated in FIG. 1. For example, at the optimum spacing of $S/R_o$=8, the peak q" (local heat flux) and q* (non-dimensional heat flux) values were approximately 180 kW/m$^2$ and 2.6 for three nozzles compared to 210 kW/m$^2$ and 4.5 for two nozzles, respectively.

When spacing was increased beyond $S/R_o$=8, the heat flux values started to decrease. At the spacing of $S/R_o$=11, the flames were, for the most part, independent of each other while still showing weak interaction at y/S=0. Previous data for a single RJRC nozzle (Mohr 6) showed the maximum local heat flux to be about q"=140 kW/m$^2$. The maximum local heat flux in the case of two RJRC flames at $S/R_o$=11.0 was approximately 150 kW/m$^2$. These data show a similarity between the single nozzle data and the peak heat flux measured for the weakly interacting nozzle pair case of $S/R_o$32 11.0 is lower compared to single of pair configuration. In order to give a more complete understanding of the interaction of the two flames, profiles of impingement surface heat flux were also obtained in the z-direction for highly, moderately, and weakly interacting flames.

Figure 9A:
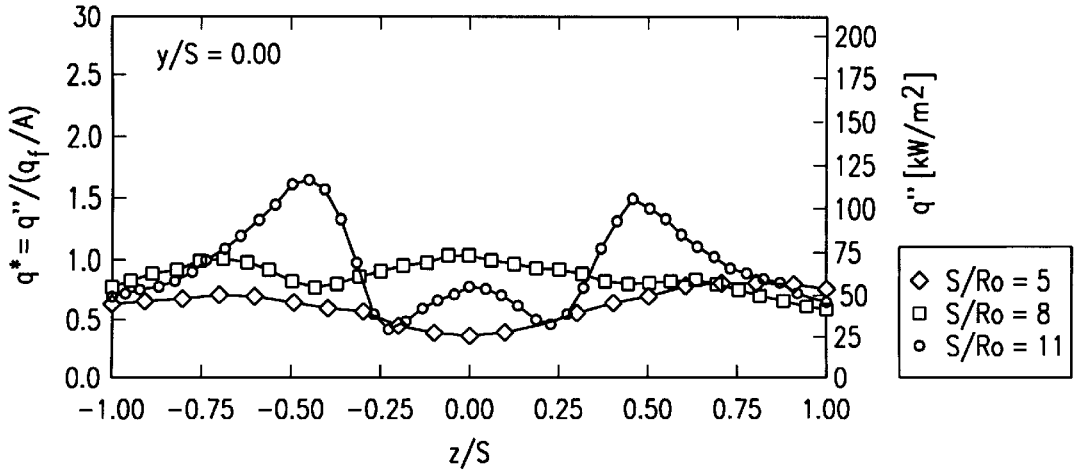
FIG. 9 is a set of graphs illustrating the impingement surface heat flux distribution in the z-direction.
Figure 9B:
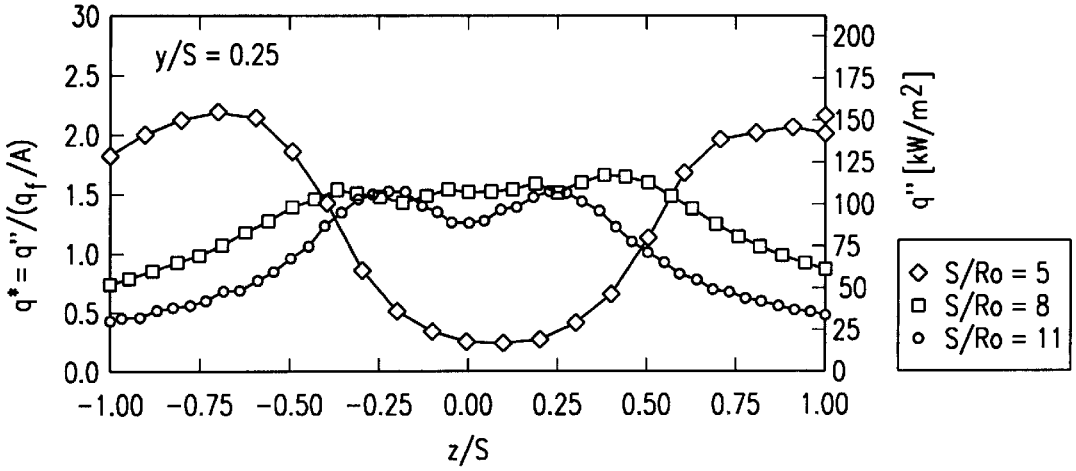
Figure 9C:
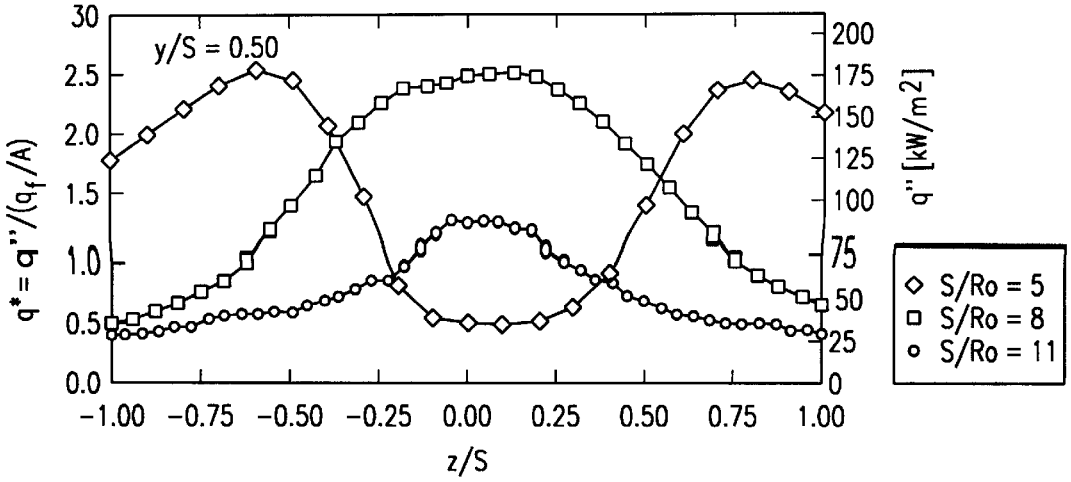

FIG. 9 is a set of graphs illustrated heat flux distribution in the z-direction of impingement surface 140. The z-direction is perpendicular to a line connecting two neighboring nozzles, such as nozzles 112 and 122, and parallel to the impingement surface. FIG. 9 shows the non-dimensional and actual local heat flux values as functions of between-nozzle spacing ratios, $S/R_o$, and location along the impingement surface, z/S, at three y/S positions. In FIG. 9 for $S/R_o$=5.0, the local heat flux is minimum at z/S=0.0. At large values (positive and negative) of z, the heat flux increases non-linearly to the measured maximum. The maximum heat flux values mark the location of both sides of the elliptical flame created by the highly interacting flames at $S/R_o$=5.0. This unique surface heat flux profile in the z-direction for $S/R_o$=5.0 is attributed to the fact that the flames did not properly impinge on the surface.

Whereas a minimum in the heat flux profile of FIG. 9 was observed at z/S=0.0 for the highly interacting flames ($S/R_o$=5.0) at all three locations of y/S, maximums in the profiles for moderately interacting ($S/R_o$=8.0) and highly interacting ($S/R_o$=11.0) flames are observed at z/S=0.0. Additional distinct peaks are also observed with $S/R_o$=11.0 at y/S=0.0. At these two larger between-nozzle spacings, each RJRC flame jet impinges on the surface, interacts with the other jet, and then exits the zone of interaction in the z-direction. However, because of the flow structure, the maximum heat flux in the z-direction is measured at y/S=0.50 with $S/R_o$ of 5 and 8 indicating that the maximum local heat flux in the z-direction along the impingement surface occurred when the nozzles were highly or moderately interacting.

Comparison of the heat flux profiles in the y and z-directions provides some additional insight into the capability of the RJRC nozzle array 150 to heat a surface. In the z-direction, very high heat fluxes are possible for both highly and moderately flames, while relatively low heat fluxes were measured for weakly interacting flames. This result is in contrast to the y-direction profiles which showed high heat flux for moderately and weakly interacting flames and low heat fluxes for the highly interacting case. Therefore, high heat fluxes in both the y and z-directions were achieved only when the flames were moderately interacting.

Impingement surface temperature distributions were also measured in the ±y and ±z-directions for the same cases shown in FIGS. 8 and 9 for impingement surface heat fluxes. The measured temperatures were in the range of 60–105° C., and followed almost exactly the observed trends in the heat flux data with respect to the influence of between-nozzle spacing (S). Because of the high conductivity of the copper impingement surface and the low temperature and high flow rate of cooling water, the impingement surface temperature remained essentially isothermal relative to the temperature of the flame (≈1500° C.). Although the measured surface temperatures are not of great practical importance in the present study, consistency between the heat flux and temperature data demonstrates the integrity of the impingement surface data presented in this work.

Based on the data from FIGS. 8 and 9, the optimal between-nozzle spacing for heat transfer system 150 including the RJRC nozzle array of nozzles 112, 122, and 132 is described. Two different criteria must be considered in determining the optimal spacing. First, uniformity of the heat flux profile along the impingement surface is an important consideration. In the y-direction, the most uniform profile occurred when the RJRC flames were highly interacting at $S/R_o=5$, while the profiles in the z-direction were generally non-uniform for all $S/R_o$ values. A second criteria used to determine the optimal spacing is the actual level of heat flux required for a particular process. Generally, a flame impingement process is used to provide a very high heat flux to a surface. For RJRC nozzle array 150, the highest heat fluxes in both directions was achieved for the moderately interacting flames at a between-nozzle spacing ratio of $S/R_o=8.0$. Also, in terms of fuel efficiency, it is clear that the moderately interacting flames produced the highest maximum heat flux for the fixed fuel input. The above trend is similar to the trend observed with the RJRC nozzle pair described in conjunction with FIGS. 1 and 2.

Based on the data from FIGS. 8 and 9, the heat flux values for the moderately interacting flames ($S/R_o=8.0$) are overall the highest. In an industrial process with more than one row of RJRC nozzles, the surface to be heated was likely move along the z-direction. By staggering neighboring arrays of RJRC nozzles in the z-direction, with each nozzle operating at a between-nozzle spacing of $S/R_o=8.0$, one would be able to provide high heat flux with approximately uniform surface profiles in the y and z-direction. Therefore, based on the above facts, the optimal between-nozzle spacing is $S/R_o=8.0$ (moderately interacting). It should be understood that heat transfer system 150 may include an array of nozzles configured in a series of rows and that adjacent rows may be offset from each other. In such a configuration, the optimal between nozzle spacing refers to the spacing between adjacent nozzles and not necessarily the spacing between parallel lines connecting each row of nozzles, although in certain non-offset embodiments, the two distances could be the same.

Figure 10:
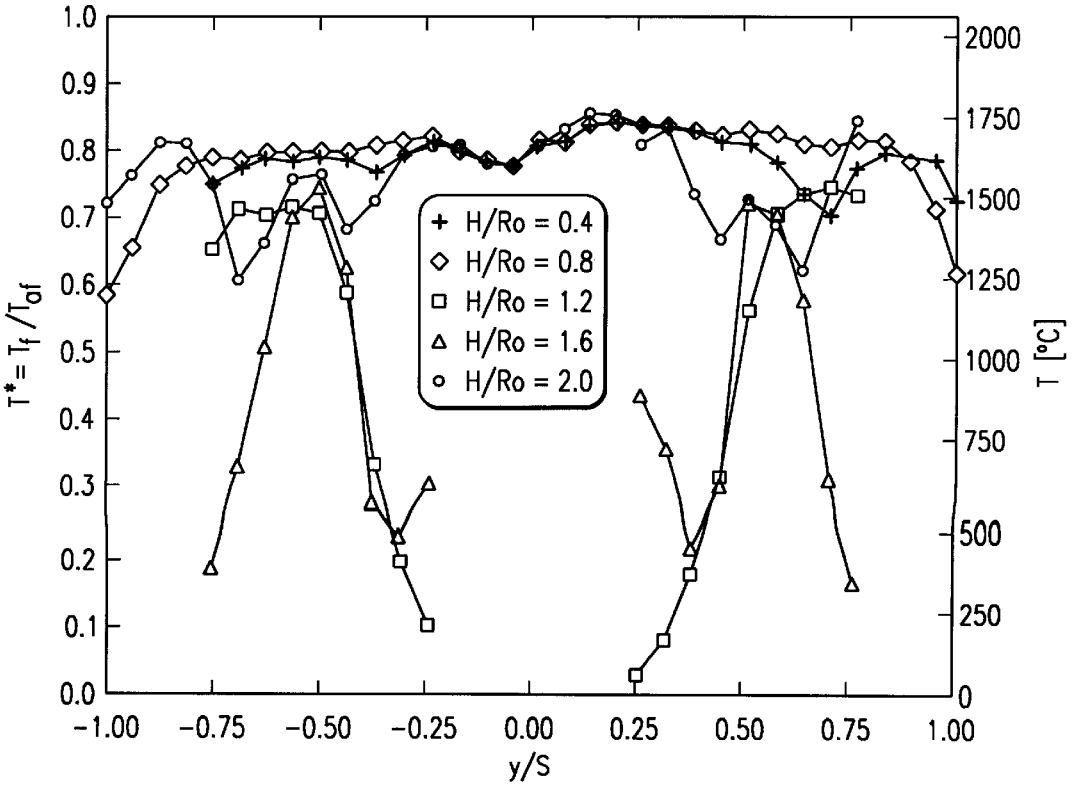
FIGS. 10 and 11 are graphs illustrating the flame temperature distribution in the z-direction.

FIG. 10 illustrates corrected non-dimensional and dimensional flame temperatures obtained along the y-axis at the optimal between-nozzle spacing of $S/R_o=8.0$. The profiles at $H/R_o=0.4$ and $H/R_o=0.8$ reached the centerline of each nozzle while the measurements for the other $H/R_o$ values were limited by the outer radius of each nozzle. The slight asymmetries in the measured temperatures about $y/S=0$ suggest the burners are not operating quite identically. The maximum temperature was measured at $H/R_o=0.8$, the magnitudes, for the most part, decreased with increasing distance from the surface.

The shapes of the temperature profiles are indicative of the observed flow structure and appearance as discussed earlier. Near the impingement surface ($H/R_o=0.4$ and 0.8) the flame temperature is relatively uniform over the entire distance between the nozzles. At approximately $y/S=\pm0.5$, a peak is observed in the temperature profiles for $H/R_o=0.8$, which is in agreement with the previously discussed flame structure and appearance. These peaks verify the existence of a secondary flame jet resulting from the combustion gasses exiting the interaction zone between the nozzles. The trend observed for flame structure in array configuration generally is very similar to the flame structure seen in between the two burners in a pair configuration, described above. In order to give a complete picture, it was deemed appropriate to measure the flame temperatures in the z-direction at $S/R_o=8.0$ and at three y/S positions.

Figure 11A:
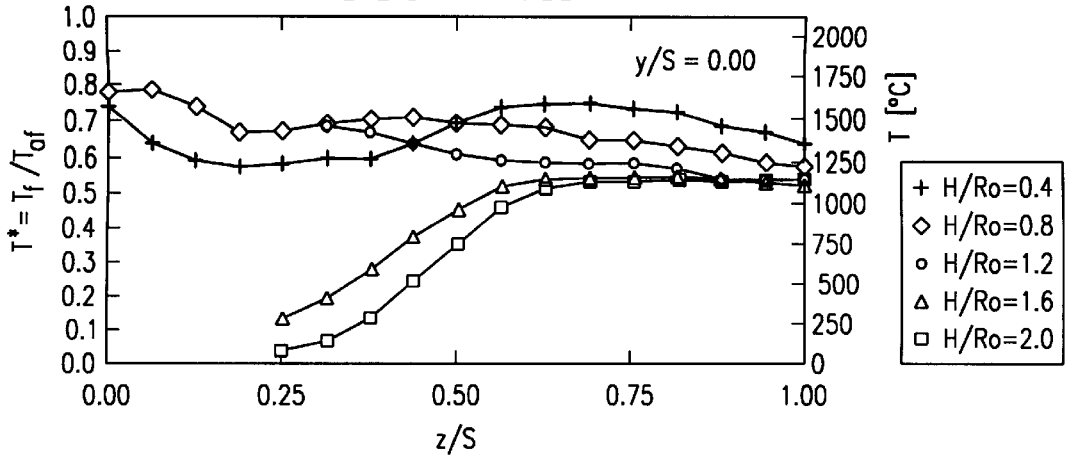
Figure 11B:
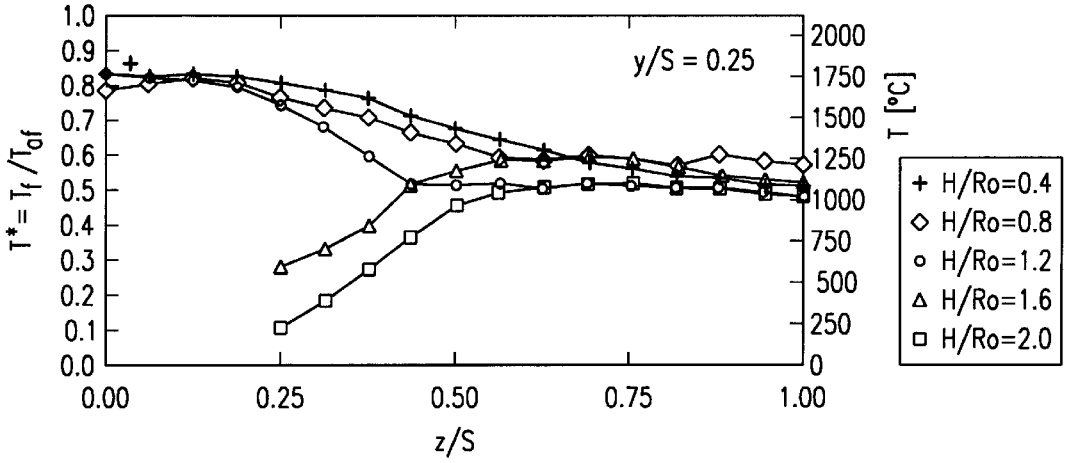
Figure 11C:
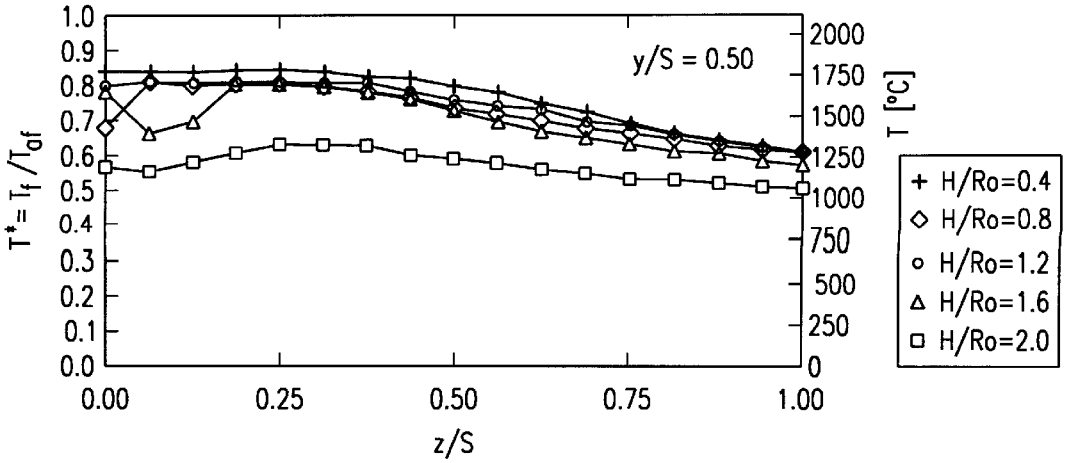

FIG. 11 shows the corrected non-dimensional and dimensional flame temperatures measured in the z-direction. Because of the reasonable symmetry of the heat flux profiles in FIG. 9 in the z-direction, profiles of flame temperatures were obtained only in the positive z-direction. The flame temperatures generally dropped with increase in z/S except for $H/R_o=1.6$ and 2.0. It is surprising though that the flame temperature is relatively uniform in the z-direction directly above a burner in an array configuration compared to a pair configuration where the flame temperature reached a maximum at $z/S\approx0.3$. Note that the highest temperatures along z/S occur for $H/R_o=0.4$ at y/S of 0.25 and 0.50 while the highest temperatures were measured for $y/S=0.0$ at $H/R=0.8$.

Thus, as described above, the interactions among the flames from nozzles 112, 122, and 132 in an array configuration were generally very similar to those observed in a pair configuration. The flow structure of the RJRC flames highly depended upon the between-nozzle spacing ratios. Highly interacting flames were observed for spacings $S/R_o<6.0$, whereas moderately interacting flames were observed over the range of spacings $6.0<S/R_o<9.0$. Separate RJRC flames were seen at $S/R_o=11.0$, where the flames were weakly interacting. The local heat flux was a strong function of between-nozzle spacing. The optimal spacing for the RJRC nozzles was determined to be at a between-nozzle spacing of $S/R_o=8.0$.

Although the present invention and its advantages have been described in detail, it should be understood that various changes, substitutions, and alterations can be made therein without departing from the spirit and scope of the present invention as defined by the appended claims.

What is claimed is:

1. A system for transferring heat to an impingement surface, comprising:

a first radial jet reattachment combustion nozzle operable to direct a flame toward the impingement surface and comprising a central longitudinal axis and an air supply pipe having a first inside radius;

a second radial jet reattachment combustion nozzle and also comprising a central longitudinal axis and an air supply pipe having a second inside radius substantially equal to the first radius; and the first and second nozzles positioned such that the central longitudinal axes are substantially parallel and spaced apart such that the ratio of the distance between the central longitudinal axes to the first inside radius of the air supply pipe is in the range of about 6 to about 9.

2. The system of claim 1, wherein the ratio of the distance between the central longitudinal axes to the first inside radius of the air supply pipe is about 8.

3. A system for transferring heat to an impingement surface, comprising:

a first radial jet reattachment combustion nozzle operable to direct a flame toward the impingement surface and comprising a first central longitudinal axis;

a second radial jet reattachment combustion nozzle operable to direct a flame toward the impingement surface and comprising a central longitudinal axis;

a third radial jet reattachment combustion nozzle operable to direct a flame toward the impingement surface and comprising a central longitudinal axis; and the first, second, and third nozzles positioned such that the central longitudinal axes are substantially parallel and flames directed from the first and second radial jet reattachment combustion nozzles interact with a flame directed from the third radial jet reattachment combustion nozzle.

4. The system of claim 3, wherein the central longitudinal axes of the first, second, and third nozzle are substantially in the same plane.

5. A system for transferring heat to an impingement surface, comprising:

a first radial jet reattachment combustion nozzle operable to direct a flame toward the impingement surface and comprising a central longitudinal axis and an air supply pipe having a first inside radius;

a second radial jet reattachment combustion nozzle operable to direct a flame toward the impingement surface and comprising a central longitudinal axis and an air supply pipe having a second inside radius substantially equal to the first inside radius;

a third radial jet reattachment combustion nozzle operable to direct a flame toward the impingement surface and comprising a central longitudinal axis and an air supply pipe having a third inside radius substantially equal to the first inside radius; and the first, second and third nozzles positioned such that the central longitudinal axes are substantially parallel and spaced apart such that the ratio of the distance between the central longitudinal axes of two adjacent radial jet reattachment combustion nozzles to the first inside radius of the air supply pipe is in the range of about 6 to about 9.

6. The system of claim 5, wherein the ratio of the distance between the central longitudinal axes of two adjacent radial jet reattachment combustion nozzles to the first inside radius of the air supply pipe is about 8.

7. A system for transferring heat to an impingement surface, comprising an array of radial jet reattachment combustion nozzles each operable to direct a flame toward the impingement surface and each having a central longitudinal axis, the array comprising at least three radial jet reattachment combustion nozzles positioned such that the central longitudinal axes of the at least three radial jet reattachment combustion nozzles are substantially parallel and spaced apart such that flames directed from at least one of the radial jet reattachment combustion nozzles interact with flames from at least two other of the radial jet reattachment combustion nozzles.

8. The system of claim 7, wherein the array further comprises at least two adjacent rows of radial jet reattachment combustion nozzles, each row having at least two radial jet reattachment combustion nozzles.

9. The system of claim 8, wherein each row forms a row axis and wherein a distance between two adjacent row axes is substantially the same as the distance between two nozzles in adjacent rows.

10. A system for transferring heat to an impingement surface, comprising:

a first radial jet reattachment combustion nozzle operable to direct a flame toward the impingement surface and comprising a central longitudinal axis;

a second radial jet reattachment combustion nozzle operable to direct a flame toward the impingement surface and comprising a central longitudinal axis; and the first and second nozzles positioned such that the central longitudinal axes are substantially parallel and spaced apart such that flames directed from the first and second radial jet reattachment combustion nozzles interact with each other.

* * * * *

UNITED STATES PATENT AND TRADEMARK OFFICE

CERTIFICATE OF CORRECTION

Patent No.: 6,007,328
Dated: December 28, 1999
Inventor(s): Jamal Seyed Yagoobi, et al It is certified that error appears in the above-identified patent and that said Letters Patent is hereby corrected as shown below:

Column 2; line 32, after "three", delete "racial" and insert --radial--.
Column 12; line 7, delete "$S/R_o$32 11.0", and insert --$S/R_o$ =11.0 --.

Signed and Sealed this

Twenty-first Day of November, 2000

*Attest:*

Q. TODD DICKINSON

*Attesting Officer*

*Director of Patents and Trademarks*